US007761209B2

(12) United States Patent
Morris et al.

(10) Patent No.: US 7,761,209 B2
(45) Date of Patent: Jul. 20, 2010

(54) OBSTRUCTION DETECTION DEVICE FOR VEHICLE DOOR AND METHOD

(75) Inventors: Steven E. Morris, Fair Haven, MI (US); Adrian B. Chernoff, Boulder, CO (US)

(73) Assignee: GM Global Technology Operations, Inc., Detroit, MI (US)

( * ) Notice: Subject to any disclaimer, the term of this patent is extended or adjusted under 35 U.S.C. 154(b) by 503 days.

(21) Appl. No.: 11/751,066

(22) Filed: May 21, 2007

(65) Prior Publication Data

US 2008/0294314 A1 Nov. 27, 2008

(51) Int. Cl.
*G06F 7/00* (2006.01)

(52) U.S. Cl. ..... 701/49; 701/36; 701/45; 340/901; 49/26

(58) Field of Classification Search ..... 701/33, 701/36, 45, 49; 340/540, 901; 318/264, 318/480, 445; 49/26, 28
See application file for complete search history.

(56) References Cited

U.S. PATENT DOCUMENTS 5,263,762 A 11/1993 Long et al.
5,955,854 A * 9/1999 Zhang et al. ..... 318/480
6,173,233 B1 1/2001 Janutka et al.
6,615,121 B2 9/2003 Li
2003/0222758 A1 * 12/2003 Willats et al. ..... 340/5.72

FOREIGN PATENT DOCUMENTS

DE 29811689 U1 12/1999
DE 10029227 C2 4/2002
DE 10331466 A1 2/2005
DE 102005023002 A1 6/2006
DE 102004063737 A1 7/2006

* cited by examiner

*Primary Examiner*—Gertrude Arthur Jeanglaud
(74) *Attorney, Agent, or Firm*—Quinn Law Group, PLLC

(57) ABSTRACT

An obstruction detection device for a motor vehicle having a door assembly movably connected to a vehicle body is provided. The device controls the vehicle door's opening angle to prevent inadvertent contact with an object foreign to the vehicle, while providing the largest opening for vehicle ingress and egress. The obstruction detection device includes a controller that is operatively connected to at least one sensor configured to actively monitor and transmit signals to the controller indicative of the presence and corresponding proximity of the object relative to the door assembly. An actuator is operatively connected to and controlled by the controller. The actuator is configured to apply a selectively variable force that restricts the movement of the vehicle door assembly with respect to the vehicle body when the door is a predetermined distance from the object.

25 Claims, 7 Drawing Sheets

OBSTRUCTION DETECTION DEVICE FOR VEHICLE DOOR AND METHOD

TECHNICAL FIELD OF THE INVENTION

The present invention relates to obstruction detection devices for vehicle doors.

BACKGROUND OF THE INVENTION

Since the early inception of the automobile (also referred to as a motor vehicle) a vehicle door or door assembly has been incorporated into the vehicle design to protect the vehicle's contents and allow for vehicle ingress and egress. The door assembly is generally hinged to the vehicle body so that the door may be pivoted to an open position and pivoted to a closed position, and will often include a latching mechanism for securing the door in the closed position. The size, weight, geometry, and opening trajectory of the door assembly will vary from vehicle to vehicle.

A standard motor vehicle door assembly includes a frame with an inner front-frame member for forming a front edge of the door assembly; an inner rear-frame member for forming a rear edge of the door assembly; a waist reinforcing member for connecting the front frame member with the rear frame member; and a hinge member for connecting the door assembly to the vehicle. The door assembly also includes a shell or housing and a window opening where a window frame is connected to the door housing. The door housing itself can be limited to two primary components: an outer panel and an inner panel or lining. Depending on the size, weight, geometry, and trajectory range for opening the door assembly, the door shell is susceptible to significant damage caused by inadvertent contact with undetected obstructions or objects foreign to the vehicle while the door assembly is moving. Large sport utility vehicles ("SUVs") and other large vehicles tend to have large doors with large door openings angles, which greatly exacerbates the potential of doing damage to the door shell while moving the door assembly from the fully closed to the fully open position.

SUMMARY OF THE INVENTION

An obstruction detection device for a vehicle door is provided that is configured to actively monitor the presence or absence, and corresponding proximity of an object relative to a vehicle door assembly, and vary the vehicle door's opening angle, or stop the vehicle door from moving, to prevent contact with the object, while providing the largest possible opening for vehicle ingress and egress. A method is also provided for selectively varying the resistance to movement of a vehicle door assembly to prevent inadvertent contact between the door assembly and the object, while providing the largest possible opening for vehicle ingress and egress.

In accordance with one aspect of the present invention, there is provided a vehicle door obstruction detection device for a motor vehicle. The obstruction detection device includes a controller operatively connected to an actuator and at least one sensor. The sensor is configured to monitor and transmit signals to the controller indicative of the presence and proximity of an object relative to the door assembly. The actuator is controlled by the controller in response to the sensor signals, and configured to apply a selectively variable force that restricts and/or stops the rotation of the vehicle door assembly with respect to the vehicle body when the door is a predetermined distance from the object, thereby preventing inadvertent contact with the object, while providing the largest possible opening for vehicle ingress and egress.

In accordance with a second embodiment of the present invention, a vehicle is provided. The vehicle comprises a vehicle body, a door assembly rotatably connected therewith, a power source disposed on the vehicle body, and a controller operatively connected to the power source and an actuator, at least one sensor, a transducer, and an interface. The actuator is controlled by the controller and configured to apply a selectively variable force to the door assembly thereby restricting its rotation with respect to the vehicle body. The at least one sensor is configured to monitor and transmit signals to the controller indicative of the presence and corresponding proximity of an object relative to the door assembly. The transducer is configured to measure and transmit signals to the controller indicative of the rotational displacement of the vehicle door assembly along a predetermined trajectory. The controller instructs the actuator to apply the selectively variable force to the door assembly, or to lock the vehicle door assembly at any position along the trajectory, in response to the sensor signals and/or the transducer signals, thereby preventing inadvertent contact with the object, while providing the largest possible opening for vehicle entry and egress. Finally, the interface allows users of the door assembly to control the actuator's application of the selectively variable force to restrict or stop the rotation of the door assembly with respect to the vehicle body.

The obstruction detection device in accordance with the above-described embodiments could be applied to any type of door assembly (i.e., a swing door or trunk lid, an engine hood, a sliding door, a lift gate, a tailgate, a winged door, or the like) on various types of motorized vehicles—cars, trucks and SUVs. Additionally, the sensor(s) could be functionally disposed at any of a number of locations on the motor vehicle (i.e., the vehicle body, the door assemblies, or the rear view mirrors) in accordance with the above-described embodiments. Finally, the means for restricting the rotation of the door assembly could be any of numerous functionally operative devices, such as a friction device or damper, an electromagnetic device or damper, a magnetorheological fluid device or damper, and/or a hydraulic device or damper.

An additional aspect of the present invention is to provide an improved method for selectively varying the movement of a vehicle door assembly to prevent inadvertent contact with obstructions, while providing the largest possible opening for vehicle ingress and egress. The method includes the steps of: creating a predetermined detection zone; monitoring the movement of the vehicle door assembly within the detection zone; sensing a presence or absence of an object within the detection zone; sensing a corresponding proximity of the object relative to the door assembly in response to movement of the door assembly along a predetermined trajectory; sensing if the proximity of the object is less than a predetermined first length; and responding to the proximity being less than the predetermined first length by selectively resisting, or controlling, the movement of the door assembly along the trajectory, and limiting the door trajectory to a point sufficiently less than the first length so as to prevent impact with the object, but sufficiently close to the first length to maximize the movement of the door assembly short of the predetermined length in order to provide the largest opening for vehicle ingress and egress without such impact.

The method presented above may further include locking the door assembly at any position along the trajectory at a point sufficiently less than a second predetermined length so as to eliminate any impact with the object, but sufficiently close to the second length in order to maximize the movement of the door assembly to a point just short of the second predetermined length to provide the largest opening for vehicle ingress and egress without such impact. As a final step, the method may include the emission of a visual, acoustic, or physical warning signal which indicates the proximity of objects relative to the door assembly.

The above features and advantages, and other features and advantages of the present invention, will be readily apparent from the following detailed description of the preferred embodiments and best modes for carrying out the invention when taken in connection with the accompanying drawings.

DESCRIPTION OF THE PREFERRED EMBODIMENTS

Figure 1A:
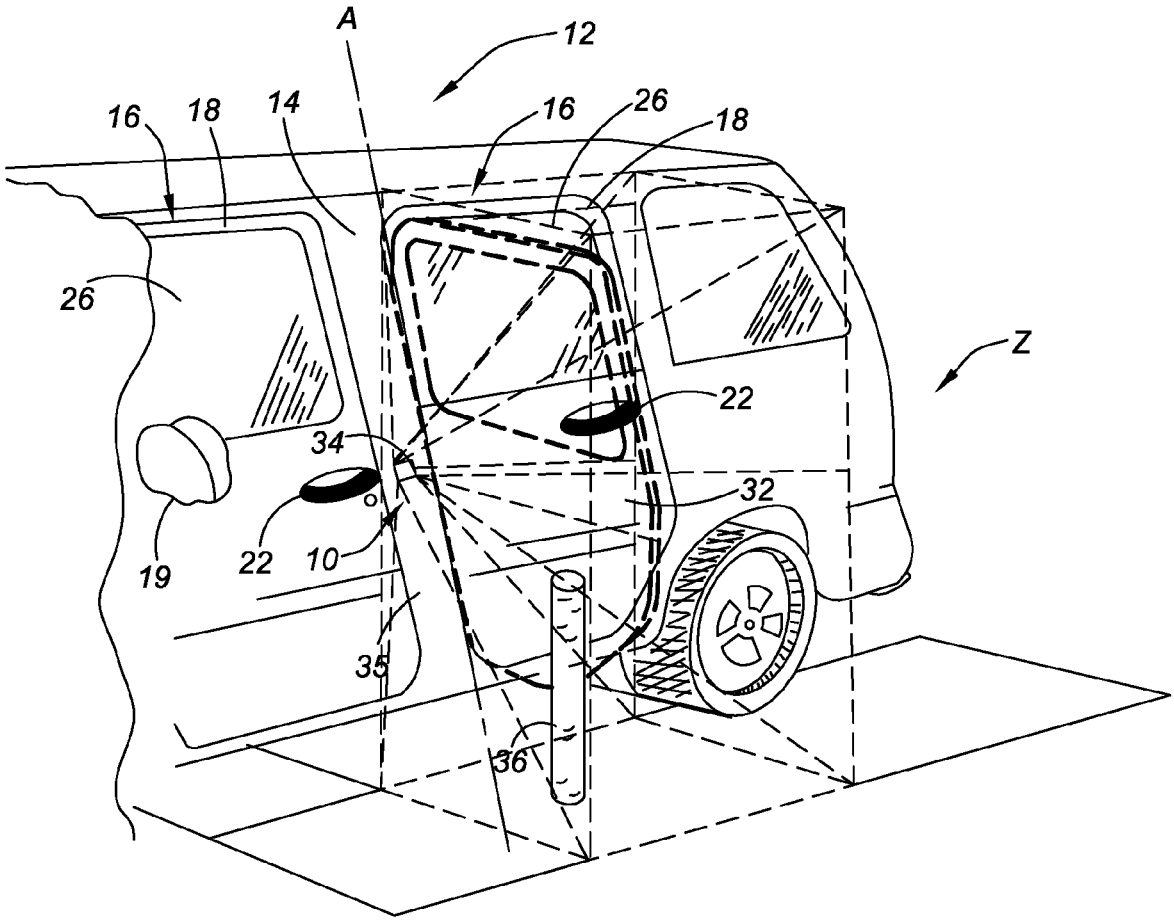
FIG. 1*a* is a fragmentary perspective view of a vehicle with an obstruction detection device assembled and installed thereupon in accordance with a first embodiment of the present invention.

Referring to the figures, wherein like reference numbers refer to like components throughout the several views, an obstruction detection device, shown generally as 10, is illustrated in accordance with a first embodiment of the present invention. FIG. 1*a* is a partial fragmentary view of a motor vehicle 12, having a vehicle body 14, upon which a door assembly 16 is rotatably mounted.

The door assembly 16 is illustrated as a side door, specifically a rear passenger door; however, any vehicle door is contemplated within the spirit and scope of the present invention, including swing doors or trunk lids, engine hoods, sliding side doors, lift gates, tailgates, winged doors or the like.

Figure 1B:
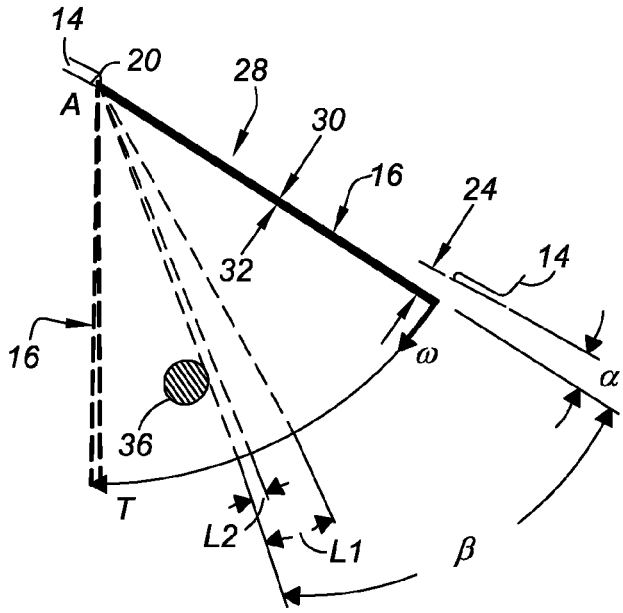
FIG. 1*b* is a schematic top plan view of the obstruction detection device and door assembly trajectory of FIG. 1*a* in accordance with the first embodiment of the present invention.

The door assembly 16 includes a door frame 18, which, for example, is pivotally connected to the vehicle body 14 about a pivot axis, identified as "A", via door hinge 20 (shown in FIG. 1*b*.) The door assembly 16 also includes a door latching mechanism 22 for securing the door in a closed position, thereby eliminating opening 24, defined as the space between the vehicle body 14 and an open position, shown by hidden lines in FIG. 1*a*, of the door assembly 16 (as best seen in FIG. 1*b*.) Further, the door assembly 16 may be provided with a window 26. The size, weight, geometry, and maximum opening angle, "α", of the door assembly 16 will vary from vehicle to vehicle. By way of example, large SUV's and sedans tend to have large door assemblies with large door openings angles.

The door assembly 16 further includes a door shell 28, defined by an outer panel or face 32 opposing an inner panel or face 30 generally facing the interior of the motor vehicle, as best seen in FIG. 1*b*. The door shell 28 encloses the components of the door assembly 16 (not shown) and may be formed from stamped sheet metal and/or a rigid polymer such as ABS plastic, and may include foam, cushioning, vinyl, fabric, wood, metal or the like, or ornamental indicia where desired to provide comfort and an aesthetic styling and design appeal to the vehicle passenger, hereinafter also referred to as an occupant or user (not shown).

Referring again to FIG. 1*a*, the obstruction detection device 10 includes at least one sensing mechanism or sensor 34. FIG. 1*a* depicts the obstruction detection device 10 consisting of a single sensor 34 disposed on the vehicle body 14 at pillar 35, sometimes referred to as a B-pillar. However, also in accordance with the present invention, the obstruction detection device 10 may include multiple sensors 34; the sensors 34 being disposed at any of a number of functional locations, such as the door assemblies 16, a rear view mirror 19, or other locations on the vehicle body 14. Furthermore, the sensor 34 may be any of a multitude of sensing mechanisms. By way of example, the sensor 34 could be an ultrasonic sensor, a laser-based radar, an infrared sensor, a geomagnetic sensor, a light-emitting device, a composite sensor, or the like within the spirit and scope of the present invention.

Referring to FIGS. 1*a*, 2*a*, 3*a*, 4*a* and 5*a*, the sensor 34 produces a detection zone Z, which envelops the door assembly 16 at any point along a predetermined trajectory T. The detection zone Z is configured so the sensor 34 can detect the presence or absence of an object 36, sometimes referred to as an obstruction(s), and actively monitor the corresponding proximity, identified as "β", of the object(s) 36 relative to the door assembly 14. Preferably, the proximity β is measured as the shortest angular distance between the outer face 32 of the door assembly 16 and the object(s) 36.

The sensor 34 is operatively connected to a controller 38 such that the sensor 34 can transmit a sensor signal or signals 40 indicative of the presence and proximity β of the obstructions 36. Those skilled in the art will recognize and understand that the means of communication between the sensor 34 and controller 38 is not restricted to the use of electric cables ("by wire") for communication, but may be, for example, by radio frequency and other wireless technology, or by electro-mechanical communication.

The controller 38 processes the signal 40 generated by the sensor 34 to first determine if an obstruction(s) 36 is within the zone Z. If an obstruction 36 is detected, the controller 38 then determines the proximity P of the obstruction(s) 36 with respect to the outer panel 32 of the door shell 28. The controller 38 then determines if the obstruction(s) 36 is less than or equal to a predetermined proximal angular distance L1 from the outer panel 32 in response to movement of the door assembly 16 along a trajectory T of predetermined length. The controller 38 can employ various methods of logic to process the sensor signals 40 and establish the distance L1 (i.e., preset system parameters, statistics, "fuzzy logic", and the like.)

The detection zone Z is depicted in FIG. 1*a* as a cuboid. However, it is contemplated within the scope and spirit of the present invention that the detection zone Z may consist of any functional shape. Furthermore, the objects or obstructions 36, depicted in FIG. 1*a* as a single concrete pillar, may consist of any object or combination of objects foreign to the vehicle 12, such as other vehicles, a garage wall, a parking block, parking meters, uneven ground clearances, and/or pedestrians.

Referring to FIGS. 2*a*, 3*a*, 4*a* and 5*a*, an actuator 42 is operatively connected to the controller 38, such that the controller 38 can selectively activate and deactivate the actuator 42 in response to the sensor signals 40. The actuator 42 is configured to apply a selectively variable force or resistance, identified as "F", which restricts the rotation of the vehicle door assembly 16 with respect to the vehicle body 14. The resistance F can be varied to gradually restrict or slow the movement of the door assembly 16 relative to the object(s) 36, for example, as a function of the proximity β, the opening angle α, and/or the angular speed ω of the door assembly 16. In addition, the controller 38 may also selectively instruct the actuator 42 to lock or stop the vehicle door assembly 16 at any position along trajectory T to completely eliminate the potential for unwanted and/or inadvertent contact between the door assembly 16 and the object(s) 36.

Figure 3A:
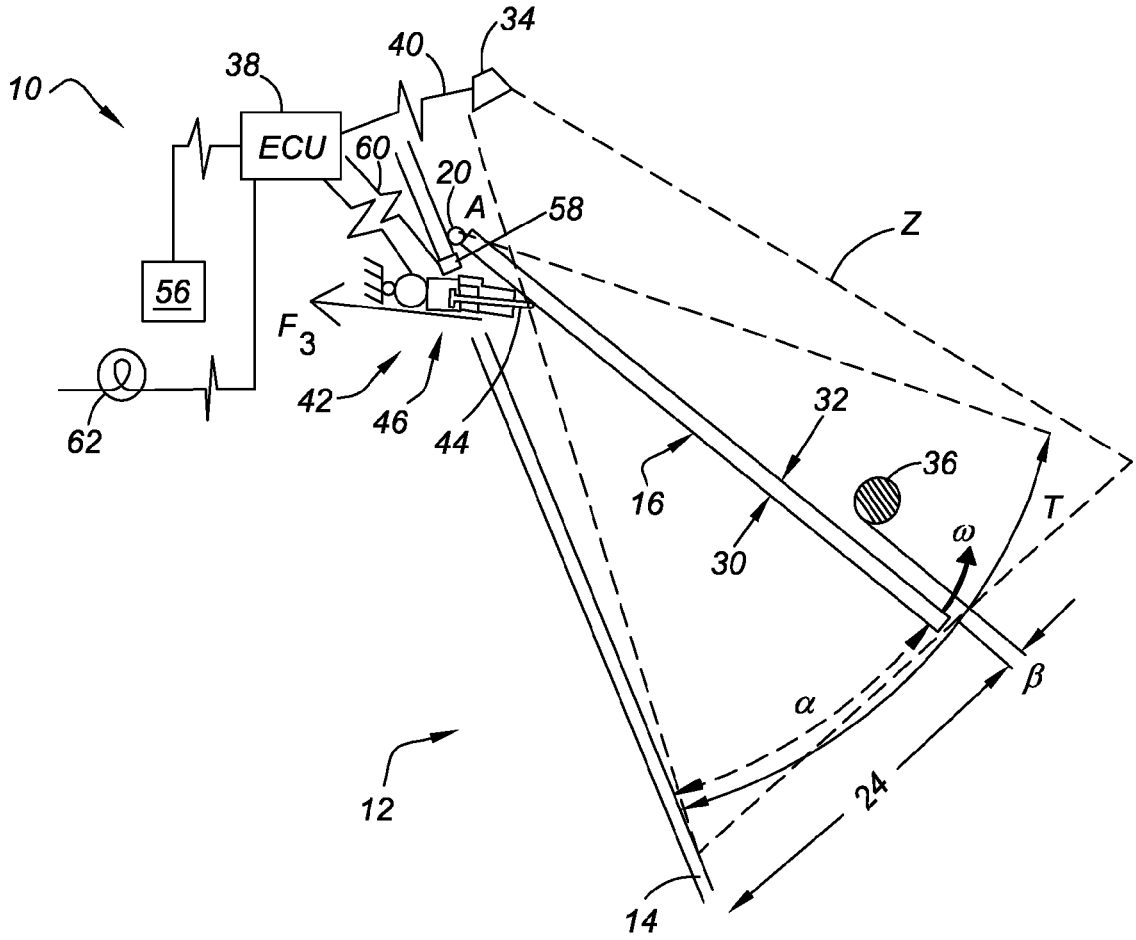
FIG. 3*a* is a schematic top plan view of the obstruction detection device and door assembly trajectory of FIGS. 1*a* and 1*b* in accordance with a third embodiment of the present invention.
Figure 3B:
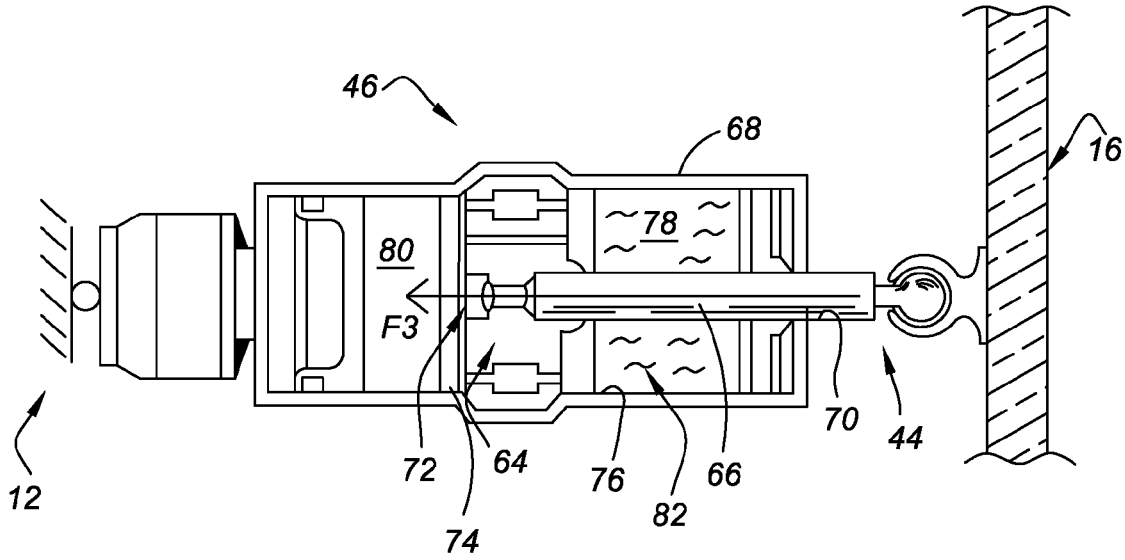
FIG. 3*b* is a schematic cross sectional view of the actuator assembly of FIG. 3*a* in accordance with the third embodiment of the present invention.

Now referring to FIGS. 3*a* and 3*b*, the actuator 42 preferably comprises a check link 44 and a magnetorheological fluid device or damper 46. A piston assembly, shown generally as 64, is connected to a piston rod 66 and is disposed within a housing tube 68. The piston rod 66 extends through the opening 70. The piston assembly 64 includes a piston body 72 that carries a band of low friction material 74 for engaging an inner damper face 76. This provides a mechanism for fluid separation between extension chamber 78 and compression chamber 80. The chamber 78 is filled with a magnetorheological fluid, shown generally as 82.

The magnetorheological fluid 82 is a type of "smart fluid", wherein the viscoelastic properties of the magnetorheologic fluid 82 can be selectively modified by applying a magnetic field of sufficient strength. Microscopic magnetic dipoles (normally fine iron) are randomly disposed and suspended in a non-magnetic fluid (hydraulic oils and the like). The applied magnetic field causes these small magnets to align and form strings, resulting in an increase in the fluid's viscosity (a rheology change). Notably, the yield stress of a magnetorheological fluid can be manipulated by varying the intensity of the magnetic field. Put another way, the fluid's ability to transmit force can be controlled with an electromagnet. As illustrated in FIGS. 3*a* and 3*b*, the increase in viscosity applies a resistance or viscoelastic damping force F3 to the piston assembly 64, which is transferred to the check link 44 via piston rod 66, thereby restricting rotation of the vehicle door assembly 16 with respect to the vehicle body 14.

Figure 2A:
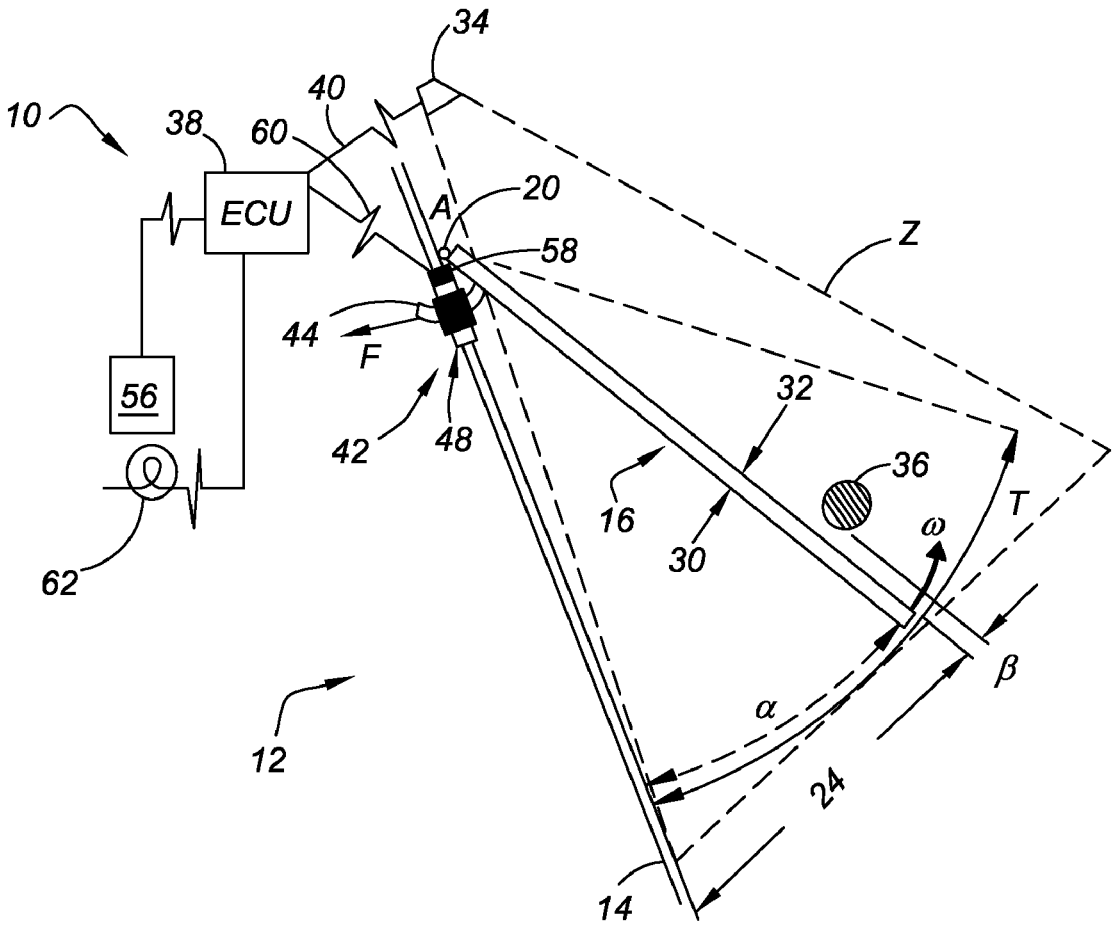
FIG. 2*a* is a schematic top plan view of the obstruction detection device and door assembly trajectory of FIGS. 1*a* and 1*b* in accordance with a second embodiment of the present invention.
Figure 2B:
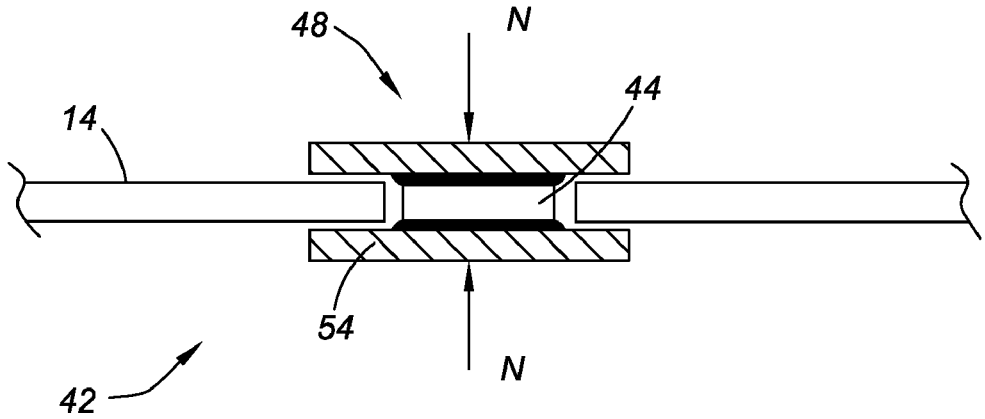
FIG. 2*b* is a schematic cross sectional view of the actuator assembly of FIG. 2*a* in accordance with the second embodiment of the present invention.

The actuator 42 may also include a check link 44 in combination with a friction device, shown generally as 48 in FIGS. 2*a* and 2*b*. The friction device 48 is configured to apply a selectively variable normal force N, via friction pads 54, to the check link 44, producing a frictional resistance or damping force F on the check link 44, thereby restricting rotation of the vehicle door assembly 16 with respect to the vehicle body 14. The drag coefficient $C_f$ on the check link 44 can be manipulated by varying the intensity of the force N, applied normal to the direction of translation of the structural check link 44.

Figure 4A:
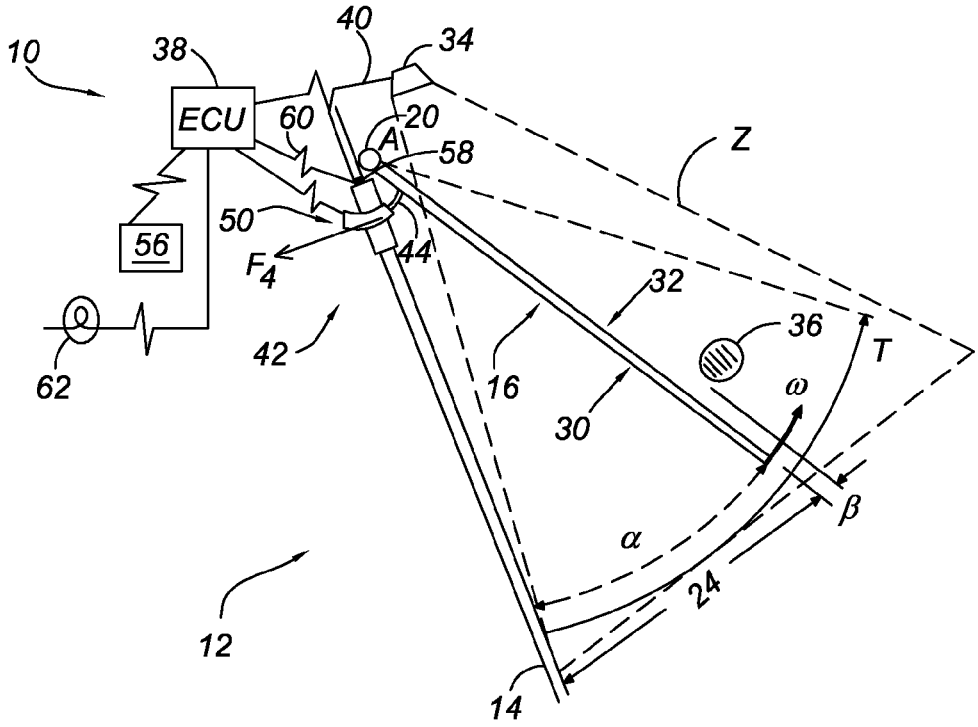
FIG. 4*a* is a schematic top plan view of the obstruction detection device and door assembly trajectory of FIGS. 1*a* and 1*b* in accordance with a fourth embodiment of the present invention.
Figure 4B:
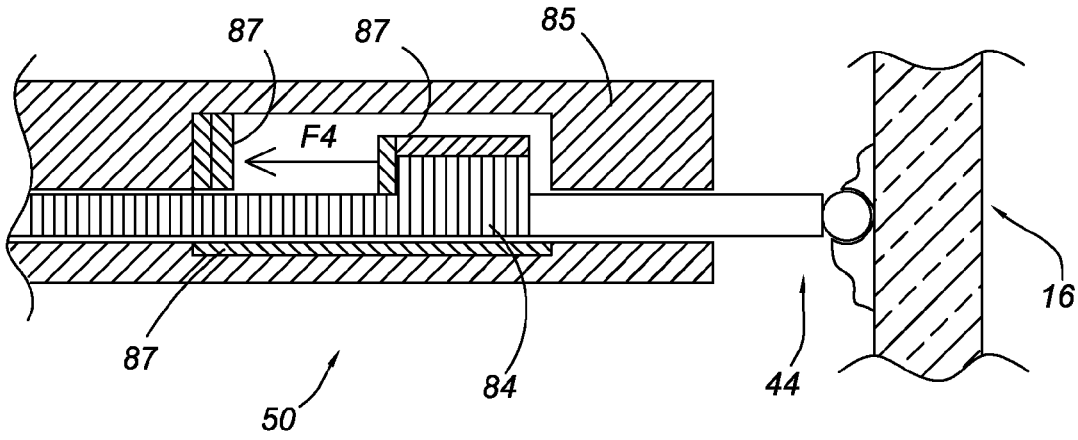
FIG. 4*b* is a schematic cross sectional view of the actuator assembly of FIG. 3*a* in accordance with the fourth embodiment of the present invention.

Alternatively, the actuator 42 used in the obstruction detection device 10 may include the structural check link 44 in combination with an electro-magnetic device or damper, shown generally as 50 in FIGS. 4*a* and 4*b*. The electromagnetic device 50 is configured to apply a selectively variable magnetic resistance or damping force F4 to the structural check link 44, thereby restricting the movement of the vehicle door assembly 16 with respect to the vehicle body 14. Magnetic damping is achieved when a conductor 84, for example a copper plate, movably disposed in housing 85, moves through a time varied magnetic field produced by permanent magnets 87. According to Maxwell's Laws, a time varying magnetic field will produce an electric field which causes circulating ("eddy") currents to flow in the conductor 84. These currents dissipate energy as they flow through the resistance of the conductor, resulting in a drag force F4 on the conductor 84.

Figure 5A:
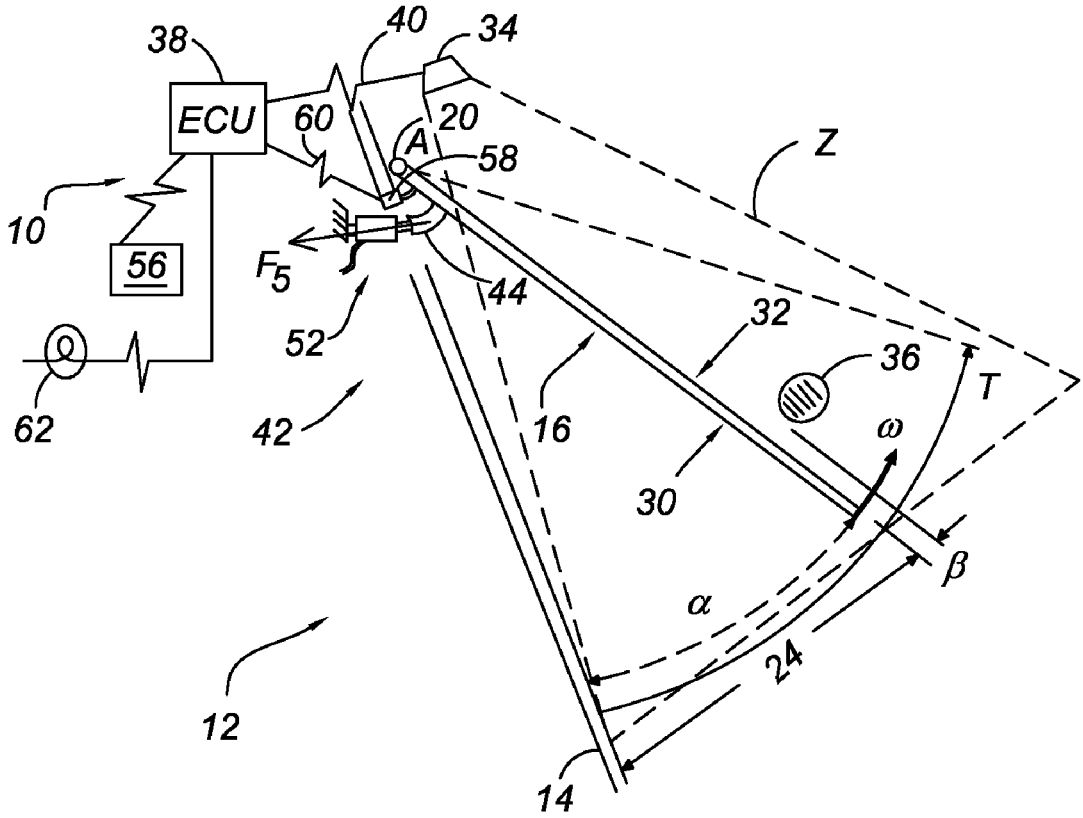
FIG. 5*a* is a schematic top plan view of the obstruction detection device and door assembly trajectory of FIGS. 1*a* and 1*b* in accordance with a fifth embodiment of the present invention.
Figure 5B:
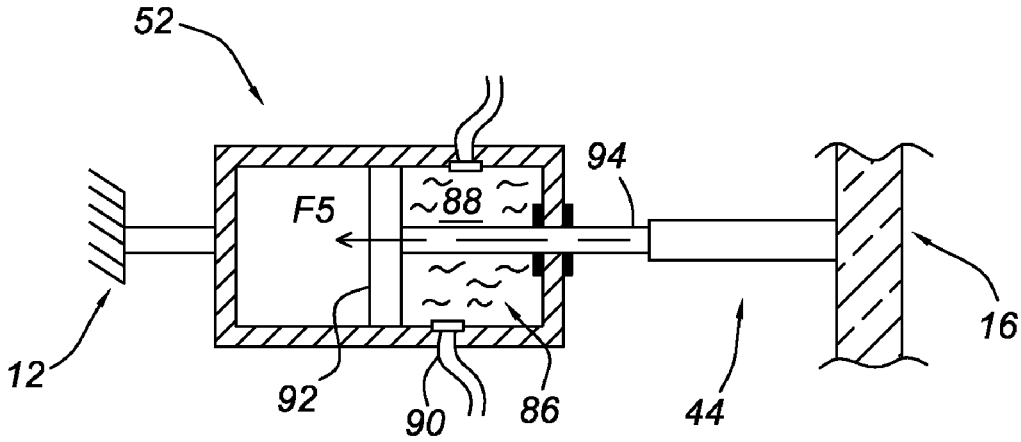
FIG. 5*b* is a schematic cross sectional view of the actuator assembly of FIG. 3*a* in accordance with the fifth embodiment of the present invention.

It is also contemplated within the scope of the embodiments described above to utilize the structural check link 44 in combination with a hydraulic damper or device, shown generally as 52 in FIGS. 5*a* and 5*b*. The hydraulic device 52 is configured to apply a selectively variable hydraulic resistance or damping force F5 to the structural check link 44, thereby restricting rotation of the vehicle door assembly 16 with respect to the vehicle body 14. Variable hydraulic damping is achieved through the manipulation (introduction and/or evacuation) of hydraulic fluid, shown generally as reference numeral 86 in FIG. 5*b*, into and out of a compression chamber 88. As fluid is fed through a first hose 90, the compressible nature of the hydraulic fluid 86 decreases, creating more hydraulic pressure, and a larger force F5, on piston head 92, which is translated to the structural check link 44 via piston rod 94. Conversely, the force F5 on check link 44 can be reduced by evacuating (or bleeding) hydraulic fluid 86 from compression chamber 88, thereby reducing the hydraulic pressure on piston head 92.

Those skilled in the art will recognize and understand that there are additional mechanisms by which the door opening angle α can be controlled, such as electro-mechanical devices, piezoelectric devices, and/or "smart materials", incorporated into the obstruction detection device 10, to apply the selectively variable force F and thereby restrict movement of the vehicle door assembly 16 with respect to the vehicle body 14. It should also be noted that the actuator 42 need not include a traditional door check link to apply the selectively variable force F to the door assembly 16, but may incorporate any functional means for allowing the motion of the door assembly 16 to be controlled by the various embodiments described herein.

Referring to FIGS. 2*a*, 3*a*, 4*a*, and 5*a*, the obstruction detection device 10 preferably includes a user interface 56, which is configured to allow users of the door assembly 16 to control the obstruction detection device 10 and corresponding movement of the door assembly 16. The interface 56 is preferably configured to allow users to manipulate the selectively variable force F, thereby increasing or decreasing the intensity of the damping force F being applied to the door assembly 16. The user interface 56 may be further configured to allow users of the door assembly 16 to selectively activate or deactivate the actuator 42, such that the vehicle door assembly 16 may be selectively stopped or locked in position at any point along trajectory T, or selectively allowed to move freely relative to the vehicle body 14, respectively. It is also contemplated within the scope and spirit of the present invention that the user interface 56 recognize a minimum override force (not shown) applied by a user of the door assembly 16 by which the controller 38 will deactivate the actuator 42, thereby allowing free motion of the door assembly 16.

The obstruction detection device 10 may further include a transducer, illustrated as element 58 in FIGS. 2*a*, 3*a*, 4*a*, and 5*a*. The transducer 58 is configured to actively measure the rotational displacement or angle α and angular speed ω of the vehicle door assembly 16 with respect to the vehicle body 14, and transmit a signal or signals, designated as element 60, to the controller 38 indicative thereof. The transducer 58 is operatively connected to the controller 38, such that the controller 38 processes the transducer signal 60 and instructs the actuator 42 to apply a selectively variable force F to vary the rotational displacement α of the door assembly 16, or stop the door assembly 16 at any point along the trajectory T.

Those skilled in the art will recognize and understand that the means for communicating between the interface 56 and the controller 38 or the transducer 58 and the controller 38, is not restricted to the use of electric cables ("by wire"), but may, for example, be by radio frequency or other wireless technology, and/or by electro-mechanical communication.

Preferably, the obstruction detection device 10 also includes a warning signal 62 configured to notify the vehicle occupant of the proximity of the object(s) 38 relative to the door assembly 16. The warning signal 62 might be visual (e.g., a flashing light), acoustic (e.g., a beeping sound), or physical (e.g., a vibrating member.)

Figure 6A:
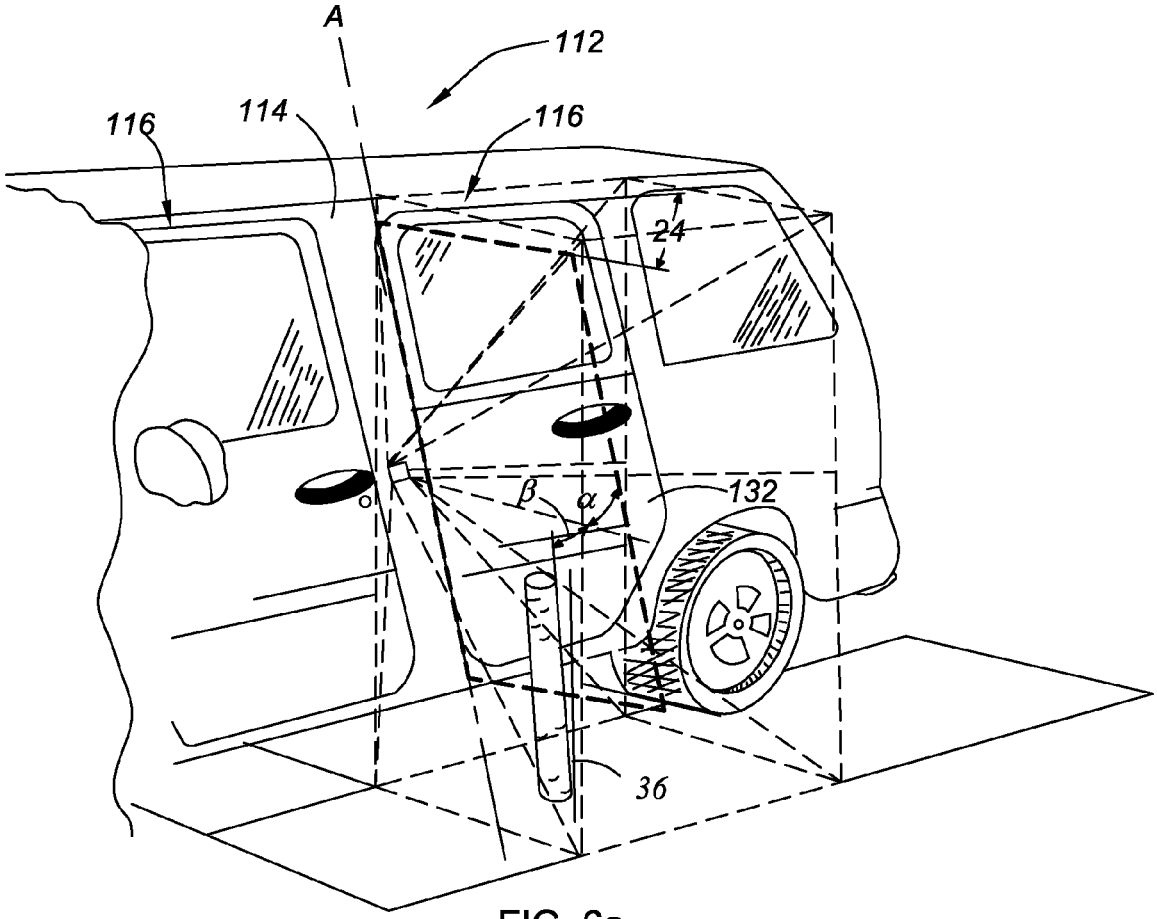
FIG. 6*a* is a fragmentary perspective view of a motor vehicle with an obstruction detection device assembled and installed thereupon in accordance with a sixth embodiment of the present invention.
Figure 6B:
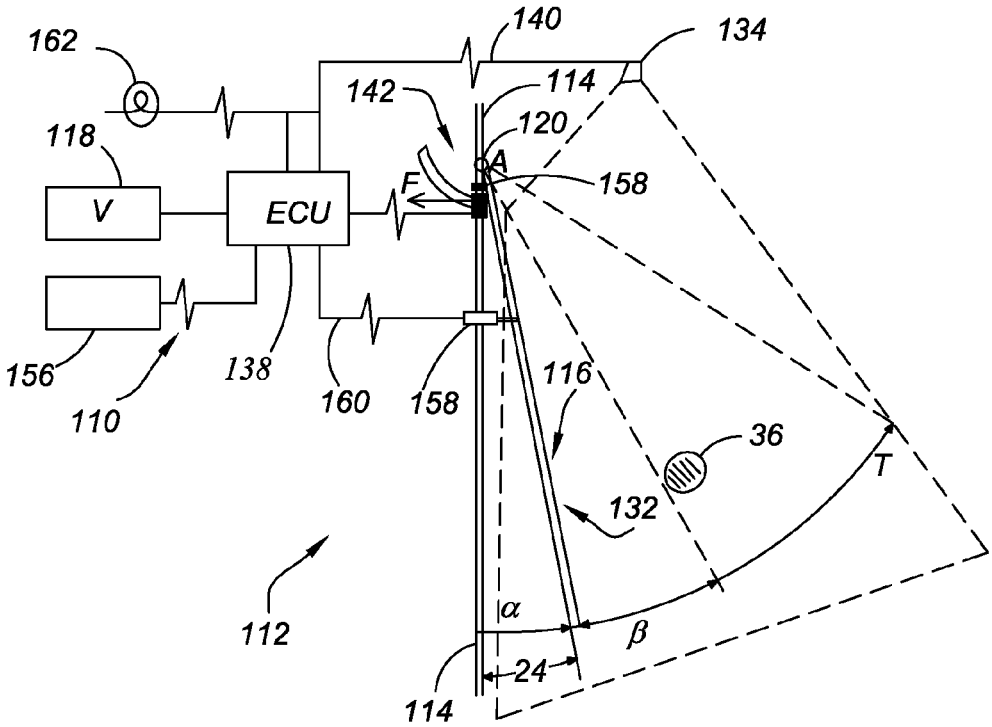
FIG. 6*b* is schematic a top plan view of the obstruction detection device and door assembly trajectory of FIG. 6*a* in accordance with the sixth embodiment of the present invention.

According to yet another embodiment of the present invention, illustrated in FIGS. 6*a* and 6*b*, an entire vehicle 112 is provided, including a vehicle body 114, a door assembly 116 (with all the features of the vehicle door assembly 16 illustrated in FIG. 1*a*) rotatably connected therewith to rotate about axis A via hinge 120, and a controller 138. The controller 138 is operatively connected to a power source 118, an actuator 142, an interface 156, at least one sensor or sensing mechanism 134, and a transducer 158. The actuator 142 is controlled by the controller 138 and configured to apply a selectively variable force F to the door assembly 116, thereby restricting its movement or rotation α relative to the vehicle body 114. The at least one sensor 134 is configured to actively monitor and transmit a signal or signals 140 to the controller 138 indicative of the presence and relative proximity of an object 36, also referred to as obstructions, with respect to the door assembly 116. The transducer 158 is configured to actively measure and transmit a signal or signals 160 to the controller 138 indicative of the rotational displacement α and angular speed ω of the vehicle door assembly 116. The controller 138 instructs the actuator 142 to apply the selectively variable force F to the door assembly 116, or to lock the vehicle door assembly 116 at any position along the trajectory T, in response to the sensor signal(s) 140 and or the transducer signal(s) 160, thereby preventing or eliminating inadvertent contact between the door assembly 116 and the obstructions 36, while providing the largest possible opening 24 for vehicle ingress and egress.

The user interface 156 allows users of the vehicle door assembly 116 to control the actuator 142 and corresponding application of the selectively variable force F. As such, the user may selectively restrict the movement of the door assembly 116 with respect to the vehicle body 114, lock the door assembly 116 at any position along trajectory T, and or disengage the actuator 142, thus allowing unfettered movement of the door assembly 116. It is preferable that the vehicle 112 also include a warning signal 162, with the same functional features as signal 62, recited above.

Figure 7:
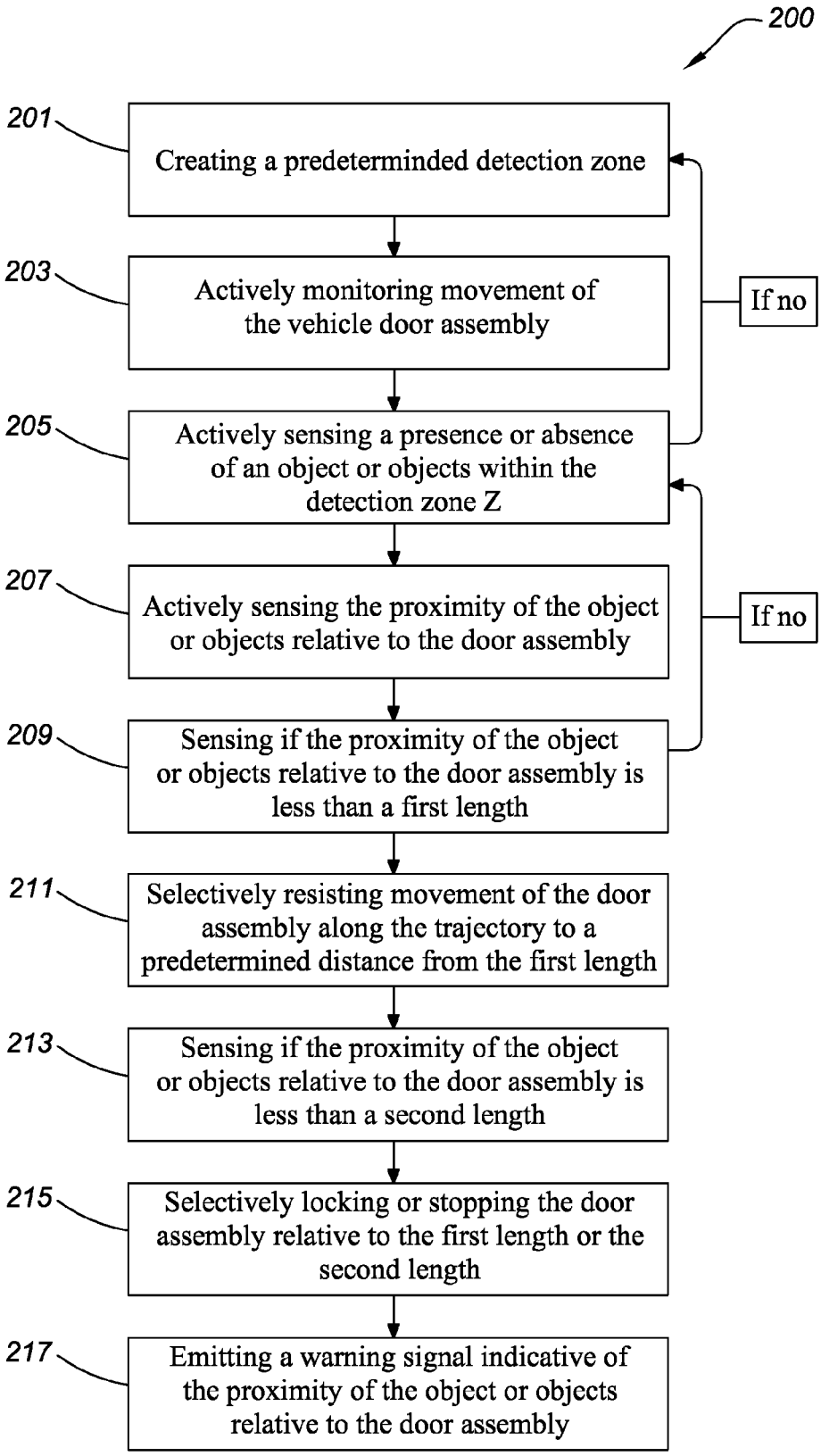
FIG. 7 is a flow chart illustrating a method for selectively varying the movement of a vehicle door assembly in accordance with the present invention.

A method for selectively varying the movement of a vehicle door assembly 200, as described below, may be employed in the respective embodiments described above; the method 200 being described with respect to the structure illustrated in FIGS. 1*a* through 6*b*. However, the method 200 may also be applied to other obstruction detection devices for various motor vehicle door assemblies. Referring to FIG. 7, the method 200 includes step 201, wherein detection zone Z is created to envelop the door assembly 16, 116 at any point during movement along trajectory T. Step 203 includes actively monitoring movement of the vehicle door assembly 16, 116 along trajectory T, within zone Z. The method 200 also includes actively sensing the presence or absence of the object 36 within the detection zone Z, as step 205. If no object 36 are detected within zone Z, the iteration of method 200 begins again at step 201. It should be noted here that steps 203 and 205 are interchangeable.

If an object 36 is detected within the zone Z, the sensor or sensors 34, 134 will thereafter actively monitor the proximity β of the object 36 relative to the outer face 32, 132 of the door assembly 16, 116 in response to the movement of the door assembly 16, 116 along trajectory T, as step 207. Step 209 requires sensing if the proximity β of the objects or obstructions 36 is less than a predetermined first length L1. If not, the method 200 returns to step 205. If yes, step 211 requires the obstruction detection device 10, 110 to respond to the proximity β of the obstructions 36 being less than the first length L1 by selectively resisting the movement of the door assembly 16, 116 along the trajectory T to a point sufficiently less than the first length L1 so as to prevent impact between the door assembly 16, 116 with the object 36. Step 211 further includes instructing the actuator 42, 142 to allow the door assembly 16, 116 to rotate to a point sufficiently close to the first length L1 in order to provide the largest opening 24, 124 between the door assembly 16, 116 and the vehicle body 14, 114 for entry into and egress from the vehicle 12, 112. The controller 38 can employ various methods of logic to process the sensor signals 40, establish the first length L1, and vary the movement of the door assembly 16 (i.e., preset system parameters, statistics, "fuzzy logic", and the like.)

The method 200 preferably also includes step 213-217. Step 213 requires sensing if the proximity β of the objects or obstructions 36 is less than a predetermined second length L2, which is preferably less than the first length L1. Step 215 requires the obstruction detection device 10, 110 to respond to the proximity β of the obstructions 36 being less than the second length L2 by locking or stopping the door assembly 16, 116 at a position along the trajectory path T at a point sufficiently less than the second predetermined length L2, so as to eliminate any possibility of impact between the door assembly 16, 116 and the object 36. Step 213, similar to step 211, allows the door assembly 16, 116 to rotate to a point sufficiently close to the second length L2 to maximize the movement of the door assembly 16, 116 to a point just shy of the second predetermined length L2 to provide the largest opening 24, 124 for ingress to and egress from the vehicle 16, 116. Finally, method 200 preferably includes, as step 217, emitting a warning signal which is configured to notify vehicle occupants of the proximity β of the object 36 relative to the door assembly 16, 116.

The terms "proximity" and "length" used in the appended claims may refer to angular or linear distances or lengths within the scope of the present invention. In other words, the sensed or determined proximities and lengths may be measured linearly from a surface, or angularly with the pivoting movement of the respective door.

While the best modes for carrying out the invention have been described in detail, those familiar with the art to which the instant invention relates will recognize various alternative designs and embodiments for practicing the invention within the scope of the appended claims. As set forth in the claims, various features shown and described in accordance with the various different embodiments of the invention as illustrated may be combined.

The invention claimed is:

1. An obstruction detection device for a motor vehicle having a vehicle body and a vehicle door assembly being selectively rotatable about an axis with respect to the vehicle body, the obstruction detection device comprising:

a controller;

at least one sensor operatively connected to the controller and configured to monitor the presence and proximity of an object relative to the vehicle door assembly and to transmit signals indicative thereof to the controller; and an actuator operatively connected to and controlled by the controller in response to the sensor signals and configured to apply a selectively variable force restricting the rotation of the vehicle door assembly about the axis with respect to the vehicle body when the door assembly is a predetermined distance from the object.

2. The obstruction detection device of claim 1, further comprising:

an interface configured to allow users of the vehicle door assembly to control the actuator.

3. The obstruction detection device of claim 2, wherein the interface is further configured to allow users of the vehicle door assembly to selectively lock the vehicle door assembly at any position along the trajectory.

4. The obstruction detection device of claim 1, further comprising:

a transducer operatively connected to the controller and configured to measure the displacement of the vehicle door assembly along a trajectory and transmit signals indicative thereof to the controller, wherein the controller is further configured to selectively command the actuator to lock the vehicle door assembly at any position along the trajectory in response to at least one of the transducer signals and the sensor signals.

5. The obstruction detection device of claim 1, wherein the actuator comprises a friction device configured to apply a selectively variable frictional resistance to the vehicle door assembly thereby restricting movement of the vehicle door assembly with respect to the vehicle body.

6. The obstruction detection device of claim 1, wherein the actuator comprises an electro-magnetic device configured to apply a selectively variable magnetic resistance to the vehicle door assembly thereby restricting movement of the vehicle door assembly with respect to the vehicle body.

7. The obstruction detection device of claim 1, wherein the actuator comprises a magnetorheological fluid device configured to apply a selectively variable viscoelastic resistance to the vehicle door assembly thereby restricting movement of the vehicle door assembly with respect to the vehicle body.

8. The obstruction detection device of claim 1, wherein the actuator comprises a hydraulic device configured to apply a selectively variable hydraulic resistance to the vehicle door assembly thereby restricting movement of the vehicle door assembly with respect to the vehicle body.

9. The obstruction detection device of claim 1, wherein the vehicle door assembly is any of a swing door or trunk lid, an engine hood, a sliding door, a lift gate, a tailgate, or a winged door.

10. The obstruction detection device of claim 9, wherein the at least one sensor is disposed on the vehicle door assembly.

11. The obstruction detection device of claim 1, further comprising:

a warning signal indicative of the proximity of the object relative to the door assembly.

12. A vehicle, comprising:

a vehicle body;

a door assembly rotatably connected with respect to the vehicle body;

a power source disposed on the vehicle body;

a controller disposed on the vehicle body and operatively connected to the power source;

an actuator operatively connected to and controlled by the controller and configured to apply a selectively variable force restricting the rotation of the door assembly with respect to the vehicle body;

an interface configured to allow users of the door assembly to control the actuator;

at least one sensor operatively connected to the controller and configured to monitor the presence and proximity of an object relative to the door assembly and to transmit signals indicative thereof to the controller; and a transducer operatively connected to the controller and configured to measure the rotational displacement of the door assembly along a trajectory and transmit signals indicative thereof to the controller, wherein the controller instructs the actuator to apply the selectively variable force to the door assembly in response to at least one of the transducer signals and the sensor signals.

13. The vehicle of claim 12, wherein the controller is further configured to selectively command the actuator to lock the door assembly at any position along the trajectory in response to at least one of the transducer signals and the sensor signals.

14. The vehicle of claim 12, wherein the interface is further configured to allow users of the door assembly to selectively lock the door assembly at any position along the trajectory and override the actuator thereby allowing free motion of the door assembly with respect to the vehicle body.

15. The vehicle of claim 12, wherein the actuator comprises a structural check link and a friction device configured to apply a selectively variable frictional resistance to the check link thereby restricting rotation of the door assembly with respect to the vehicle body.

16. The vehicle of claim 12, wherein the actuator comprises a structural check link and an electro-magnetic device configured to apply a selectively variable magnetic resistance to the structural check link thereby restricting rotation of the door assembly with respect to the vehicle body.

17. The vehicle of claim 12, wherein the actuator comprises a structural check link and a magnetorheological fluid device configured to apply a selectively variable viscoelastic resistance to the structural check link thereby restricting rotation of the door assembly with respect to the vehicle body.

18. The vehicle of claim 12, wherein the actuator comprises a structural check link and a hydraulic device configured to apply a selectively variable hydraulic resistance to the structural check link thereby restricting rotation of the door assembly with respect to the vehicle body.

19. The vehicle of claim 12, wherein the vehicle door assembly is any of a swing door or trunk lid, an engine hood, a sliding door, a lift gate, a tailgate, or a winged door.

20. The vehicle of claim 19, wherein the at least one sensor is disposed on the door assembly.

21. The vehicle of claim 19, wherein the at least one sensor is disposed on the vehicle body.

22. The vehicle of claim 19, further comprising:

a vehicle rear view mirror, wherein the at least one sensor is disposed on the rear view mirror.

23. The vehicle of claim 12, further comprising:

a warning signal indicative of the proximity of the object relative to the door assembly.

24. A method of selectively varying the movement of a vehicle door assembly, comprising:

creating a predetermined detection zone;

monitoring movement of the vehicle door assembly within the detection zone;

sensing a presence or absence of an object within the detection zone;

sensing a proximity of the object relative to the door assembly in response to movement of the door assembly along a predetermined trajectory;

sensing if the proximity of the object is less than a predetermined first length; and responding to the proximity being less than the first length by selectively resisting movement of the door assembly along the trajectory to a point sufficiently less than the first length so as to prevent impact between the door assembly and the object, and sufficiently close to the first length to maximize the movement of the door assembly short of the first length to provide the largest opening for vehicle ingress and egress without such impact.

25. The method of claim 24, further comprising:

sensing if the proximity of the object is less than a predetermined second length; and responding to the proximity being less than the second length by locking the door assembly at any position along the trajectory at a point sufficiently less than the second length so as to eliminate any impact with the object, and sufficiently close to the second length to maximize the movement of the door assembly short of the second length to provide the largest opening for vehicle ingress and egress without any impact.

* * * * *